US011091973B2

(12) United States Patent
Hoel

(10) Patent No.: US 11,091,973 B2
(45) Date of Patent: Aug. 17, 2021

(54) WELLHEAD SYSTEM AND JOINTS

(71) Applicant: Karl-Willie Hoel, Oslo (NO)

(72) Inventor: Karl-Willie Hoel, Oslo (NO)

( * ) Notice: Subject to any disclaimer, the term of this patent is extended or adjusted under 35 U.S.C. 154(b) by 0 days.

(21) Appl. No.: 15/532,986

(22) PCT Filed: Dec. 3, 2015

(86) PCT No.: PCT/NO2015/050237
§ 371 (c)(1),
(2) Date: Jun. 2, 2017

(87) PCT Pub. No.: WO2016/089221
PCT Pub. Date: Jun. 9, 2016

(65) Prior Publication Data
US 2017/0321510 A1 Nov. 9, 2017

(30) Foreign Application Priority Data
Dec. 3, 2014 (NO) ..... 20141460

(51) Int. Cl.
*E21B 33/038* (2006.01)
*E21B 33/037* (2006.01)

(52) U.S. Cl.
CPC ..... *E21B 33/038* (2013.01); *E21B 33/0375* (2013.01)

(58) Field of Classification Search
CPC ..... E21B 33/038
See application file for complete search history.

(56) References Cited

U.S. PATENT DOCUMENTS

| | | | | |
|---|---|---|---|---|
| 2,730,799 | A | 1/1956 | Walker | |
| 3,067,593 | A | 12/1962 | McCool | |
| 5,029,647 | A | 7/1991 | Milberger et al. | |
| 5,163,602 | A * | 11/1992 | Usui | B21C 37/06 228/143 |
| 8,297,366 | B2 * | 10/2012 | Olvera | E21B 33/03 166/382 |
| 8,678,447 | B2 * | 3/2014 | Chin | E21B 17/042 285/333 |
| 9,133,533 | B2 * | 9/2015 | Antunes | B21J 5/08 |
| 2008/0257808 | A1 * | 10/2008 | Weeks | C25D 5/36 210/181 |

(Continued)

FOREIGN PATENT DOCUMENTS

| | | | |
|---|---|---|---|
| EP | 0 062 449 | A2 | 10/1982 |
| WO | WO 2009/067773 | A1 | 6/2009 |

(Continued)

OTHER PUBLICATIONS

API Engineering Oil Gas, May 2, 2017, www.api-engineering.com (Year: 2017).*

(Continued)

*Primary Examiner* — Aaron L Lembo
(74) *Attorney, Agent, or Firm* — K&L Gates LLP

(57) ABSTRACT

The present invention relates to an upper subsea wellhead surface joint, a lower subsea wellhead surface joint, an upper subsea wellhead conductor joint, and a lower subsea wellhead conductor joint. According to the present invention, these are machined from a single piece of forged steel material and corrosion protected by means of an electrolytic or other process.

18 Claims, 15 Drawing Sheets

(56) References Cited

U.S. PATENT DOCUMENTS

Figure 1A:
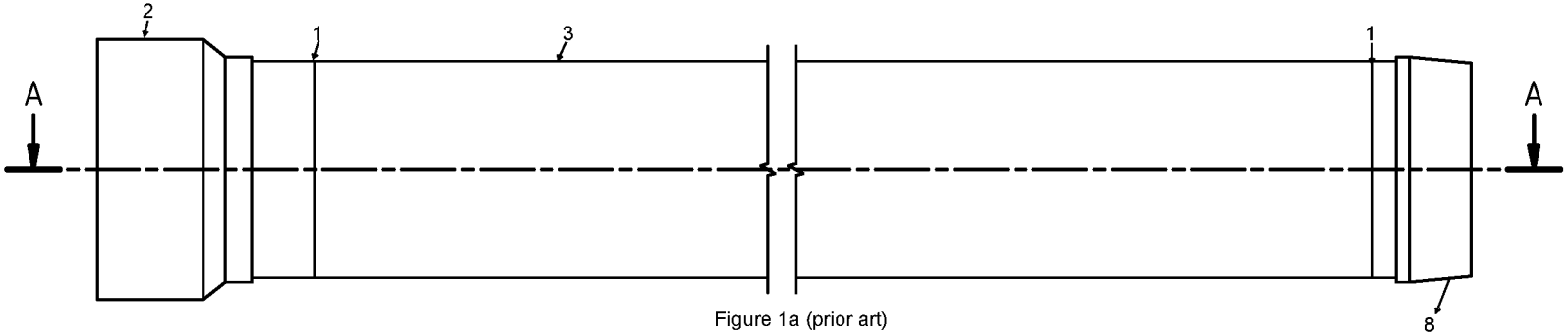
Figure 1a (prior art)

2012/0085544 A1 4/2012 Shilling et al.

FOREIGN PATENT DOCUMENTS

WO WO 2010/024829 A1 3/2010
WO WO 2012/049289 A1 4/2012

OTHER PUBLICATIONS

International Preliminary Report on Patentability issued in PCT/NO2015/050237 dated Oct. 18, 2016.
International Search Report and Written Opinion issued in PCT/NO2015/050237 dated Mar. 9, 2016.

* cited by examiner

A–A

STRESS RANGE 200 MPa x SCF = 240 MPa
STRESS RANGE 200 MPa
C1 free corrosion
C1 CP
B1 free corrosion
B1 CP
HS CP
C1
C1 CP
B1
B1 CP
HS CP
1000
100
10
Stress range (Mpa)
10000
100000
1000000
10000000
100000000
Number of cycles

WELLHEAD SYSTEM AND JOINTS

CROSS-REFERENCE TO RELATED APPLICATIONS

This application is a National Stage entry of International Application No. PCT/NO2015/050237, filed Dec. 3, 2015, which claims priority to Norwegian Patent Application No. 20141460, filed Dec. 3, 2014. The disclosure of the priority applications are hereby incorporated in their entirety by reference.

FIELD OF THE INVENTION

The present invention relates to an improved subsea wellhead system and a method for providing such a wellhead.

BACKGROUND OF THE INVENTION

The potential for severe fatigue damage of the wellhead system has increased over the last few years due to use of $5^{th}$ and $6^{th}$ generation drilling vessels and considerably longer well operations. Prior art wellhead systems design is not optimized with respect to fatigue life due to the design and fabrication method that is based on welding of parts together and the post weld heat treatment, PWHT, of the welded connections, clad welding of the sealing surfaces and PWHT after clad welding. Due fabrication by welding parts together and clad welding of the sealing surfaces the fatigue life is calculated, in best case, according to the C1 curve. Therefore fatigue life of prior art wellhead systems is typically the limiting factor for offshore drilling, completion and workover activities.

The upper part of any subsea template or satellite wellhead systems is exposed to high tension and bending loads during drilling, completion and workover operations. The loads are generated by the surface vessel motions. The variable riser tension loads are transferred via the marine riser and the BOP to the upper wellhead housing. High bending moments occur when the tension loads are applied at an angle relative to the wellhead center axis.

Subsea wellhead systems can also be exposed to high frequency vibrations imposed by the marine riser, known as vortex shedding. If the cylindrical structure, ref. the marine riser, is not mounted rigidly and the frequency of vortex shedding matches the resonance frequency of the structure, the structure can begin to resonate, vibrating with harmonic oscillations driven by the energy of the flow.

Large cyclic bending moments and high frequency vibrations are known to cause fatigue damage to subsea wellhead system. Therefore wellhead systems should be designed and manufactured with respect to being best suited to avoid severe fatigue damage.

The annulus between the conductor casing and the drilled hole is cemented from below to the seabed. Theoretically and optimally, the conductor should be fixed all the way from bottom to the top. However, this is usually not the case. The top layer of the seabed may be very soft clay or sand with low shear strength. The lateral support of the soft soil is minimal. The upper part of the hole may be wide as a conical shaped ditch with no lateral support. Limited lateral support of the conductor can be compensated by increased outer diameter and wall thickness of the conductor string.

Deeper into the well, the lateral support is provided by consolidated sediments. The fix point of the wellhead is defined as the "point below the seabed" where the conductor cannot move laterally. From the fix point and down, the soil is consolidated, the cement job is completed with filling of all cavities, and the cement bonding is proper. Below the fix-point the wellhead system is mainly exposed to static axial loads.

Typically the structural part of a subsea wellhead system includes a 30"-36" conductor string and a 20"-22" surface string. For both strings the upper joint includes typically three parts that are welded to each other by two girth welds. At the top there is a forged housing, typically named the conductor housing and the 18¾" wellhead housing. In the middle there is a pipe. Typically there is a large wall thickness transition from the 18¾" wellhead forged housing to the pipe. There is also a wall thickness transition between the conductor housing and the pipe. At the bottom there is a threaded machined forging, typically a pin connector.

Housings are generally defined as the uppermost part of the conductor and surface string. The housings are typically fabricated from low alloy high strength forged material machined with a bottom weld prep for girth welding to the pipe.

The housings are machined with internal and external profiles for running tools for installation of the conductor and surface string and landing shoulders for landing of the wellhead housing inside the conductor housing.

The conductor housing includes typically holes for fluid return and interface areas for connection of the drilling or production guide base.

The wellhead housing includes typically external locking profiles for connection of the BOP or X-mas tree connector. The wellhead housing is also called the high pressure housing as it is designed to resist full well bore pressure. The wellhead housing typically includes internal landing and lockdown profiles for casing hangers and sealing areas for annulus seals and the BOP/XMT metal gasket.

It is known to include a fortified forged section in between the wellhead housing and the pipe. Two welds are required. The typical length of the fortified section is in the range of 1-2 meter.

High capacity pin and box connectors are typically made from high grade pre-machined forgings that are welded to the bottom part of the pipe.

Most oil industry suppliers have developed a preload mechanism that ensures contact with a load of 1-2 million pounds between the wellhead housing and the conductor housing. The purpose is to transfer bending moments from the wellhead housing to the conductor string. The preload mechanism does also counteract lift-off forces due to thermal expansion.

Typically the inner housing lands onto a landing shoulder of the outer housing. The landing shoulder can also be defined as the upper reaction point. Below the landing shoulder there is a narrow radial tolerance between the inner and outer housings. When exposed to bending loads the inner housing will rotate slightly until the inner housing contacts the outer housing. The point at which the inner housing contacts the outer housing is named the lower reaction point. A reaction point is generally defined as the contact points between the high pressure and low pressure housings, creating the coupled pairs, when the high pressure housing is exposed to bending moments. The loads acting on the upper and lower reaction points create a coupled pair. A coupled pair is generally understood as a pair of equal, parallel forces acting in opposite directions and tending to produce rotation. The coupled pairs are reacted by the outer housing.

It is also possible to land the wellhead housing inside the conductor housing such that the inner housing and the outer housing wedge with no radial clearance within another to stabilize movement of the inner housing, ref U.S. Pat. No. 5,029,647 (A)—1991 Jul. 9. The brand name of this moment rigid connection is: "dual-tapered socket design". This solution is also based on an upper and lower reaction point.

The next joints below the upper joint are for prior art technology also typically fabricated by three parts which are welded to each other by two girth welds. At the top there is typically a female connector, named the box. In the middle there is a pipe. At the bottom there male connector, named the pin. The following joints below are fabricated in a similar manner.

The general problems with conventional well head systems outlined above are summarized in a presentation held by Dr. Hugh Howells from the company 2H, 30 Oct. 2013, IBC, $2^{nd}$ Annual Drillships Conference in Seoul, Korea, called "Mitigating Drilling Riser an Conductor Fatigue", which is enclosed.

It is known in the industry to machine drill-pipe, high pressure production risers and workover risers from one single piece of forging with no weldings, ref. enclosed marketing leaflet from TuffRod (http://tuffrod.com/drill-rod-university/). It is also known to fabricate small bore production tubing by hot forged upsets. However, the use, production, and requirements of drill-pipe, risers and production tubing are entirely different from wellhead systems engineering, and there limited possibility for technology knowledge transfer between the fields.

THE AIM OF THE INVENTION

It is an aim of the invention to provide an enhanced subsea wellhead system with significantly extended fatigue life and increased structural strength, as compared to conventional wellhead systems.

It is aim of the invention to provide an enhanced subsea wellhead system that reduces or eliminates the risk of fatigue damage during offshore drilling, completion and workover operations.

It is an aim of the invention to provide an enhanced subsea wellhead system that is applicable for pre-loaded or non-pre-loaded wellhead systems for both template wells and satellite wells.

It is an aim of the invention to provide an enhanced subsea wellhead system that is cheaper to produce, requires fewer production steps, and requires involvement of fewer production providers, thus reducing the number of transport pitches between various production facilities specializing on specific production steps.

It is an aim of the invention to provide an enhanced subsea wellhead system that has a more predictable lifetime.

It is an aim of the invention to provide an enhanced subsea wellhead system that safely and predictably can carry todays heavier BOPs.

It is an aim of the invention to provide an enhanced subsea wellhead system that safely and predictably can carry even heavier BOPs than are used today.

It is an aim of the invention to provide an enhanced subsea wellhead system that safely and predictably can withstand todays drilling, completion and workover operations requirements.

It is an aim of the invention to provide an enhanced subsea wellhead system that safely and predictably can withstand drilling, completion and workover operations that are tougher on the wellhead than today's drilling operations.

It is an aim of the invention to provide an enhanced subsea wellhead system that safely and predictably can expand the weather window for drilling operations, completion and workover operations, thereby reducing WOW (Waiting On Weather) disruptions and reducing the operational costs.

It is an aim of the invention to provide an enhanced subsea wellhead system that reduces the risk of environmental catastrophe, reduces the risk of human injury and loss of lives and reduces the risk of capital losses.

It is an aim of the invention to provide an enhanced subsea wellhead system that can be standardized.

It is the aim of the invention to provide an enhanced subsea wellhead system where it is possible to increase the distance between the coupled pairs.

It is an aim of the invention to provide an enhanced subsea wellhead system where it is possible to increase structural capacity by introducing new geometry of the surface string.

SHORT SUMMARY OF THE INVENTION

According to one aspect of the present invention, the upper and lower joints of the conductor string and surface string are machined from one piece extended forging.

According to one aspect of the present invention, both the conductor string and surface string upper joints are designed with integral housings at the upper end and integral connectors at the lower end.

According to one aspect of the present invention, both the conductor string and surface string lower joints are designed with integral connectors, typically box up, at the upper end and pin down, at the lower end. The position of the box and pin connectors can be reversed.

According to one aspect of the present invention, girth welding of housings or connectors to pipe is eliminated.

According to one aspect of the invention local post weld heat treatment after girth welding is eliminated.

According to one aspect of the present invention, the conductor and surface joints includes fewer structural parts, hence each joint can be manufactured with fewer process steps, faster and to lower costs than conventional wellhead joints.

According to one aspect of the present invention, each joint may be designed with increased outer diameter, increased wall thickness, smoother transitions, uniform wall thickness and uniform material properties.

According to one aspect of the present invention, each joint may be internally and externally corrosion protected.

According to one aspect of the present invention, the purpose of the general corrosion protection is to ensure fatigue life calculations according to the higher curves such as e.g. the B1 CP and HS CP curve.

According to one aspect of the present invention, the internal and external corrosion protection may be applied by an electrolytic process or by other methods that ensures general corrosion protection without heat effects that affects the material properties or the basis for fatigue calculations according to B1 and the HS curves.

According to one aspect of the present invention, the general corrosion protection may be provided by one or more layers of alloys such as e.g. CrNi alloy or other alloys and/or non-alloys such as e.g. Zn, Al or Ag or combination of layers of alloys and non-alloys.

According to one aspect of the present invention, the general corrosion protection can also be provided by paint compounds with corrosion protection pigments such as e.g. Zn powder.

According to one aspect of the present invention, the general corrosion protection can also be provided to prior art technology in order to allow for fatigue life calculations according to the C1. CP curve rather than the C1 curve with free corrosion According to one aspect of the present invention, low alloy steel with yield up to 500 MPa may be used in order to achieve calculations according to the B1 free corrosion curve.

According to one aspect of the present invention, low alloy steel with yield up to 500 MPa and with general corrosion protection may be used in order to calculate the fatigue life according to the B1 CP curve.

According to one aspect of the invention, low alloy steel with yield strength equal to or above 500 MPa with general corrosion protection and surface finish better that Ra 3.2 may be used in order to calculate the fatigue life according to the HS CP curve.

According to one aspect of the present invention the sealing surfaces may be protected by one or more layers of corrosion resistant alloys or non-alloys or combination of alloys and non-alloys that may be applied by an electrolytic process or other methods that ensures corrosion protection of the sealing surfaces without heat effects that affects the material properties or the basis for fatigue calculations according to B1 and the HS curves.

According to one aspect of the present invention clad welding of corrosion resistant alloy on the sealing areas and corresponding heat treatment after clad welding of the prior art wellhead housing is eliminated and substituted by corrosion protection with processes without heat effects that affects the material properties or the basis for fatigue calculations according to B1 and the HS curves According to one aspect of the present invention, the enhanced subsea wellhead may be included into the design of any oil industry suppliers' wellhead system with limited impact on the supplier's existing technology and without disturbance of external interfaces. Internal interfaces to existing running tools, casing hangers and annulus seals will not be influenced and can remain as is.

According to one aspect of the present invention, the fatigue life and the structural capacity of any preloaded or non-preloaded satellite or template wellhead system can be increased.

The present invention according to the enclosed claims provides an improved wellhead system and a method for providing such a wellhead that fulfills at least one of the abovementioned aims. In the following, a detailed non-limiting description of various embodiments of the present invention is given with reference to the enclosed drawings, where FIG. 1*a* shows a typical prior art upper conductor joint, FIG. 1*b* shows the section A-A in FIG. 1*a,*

Figure 1B:
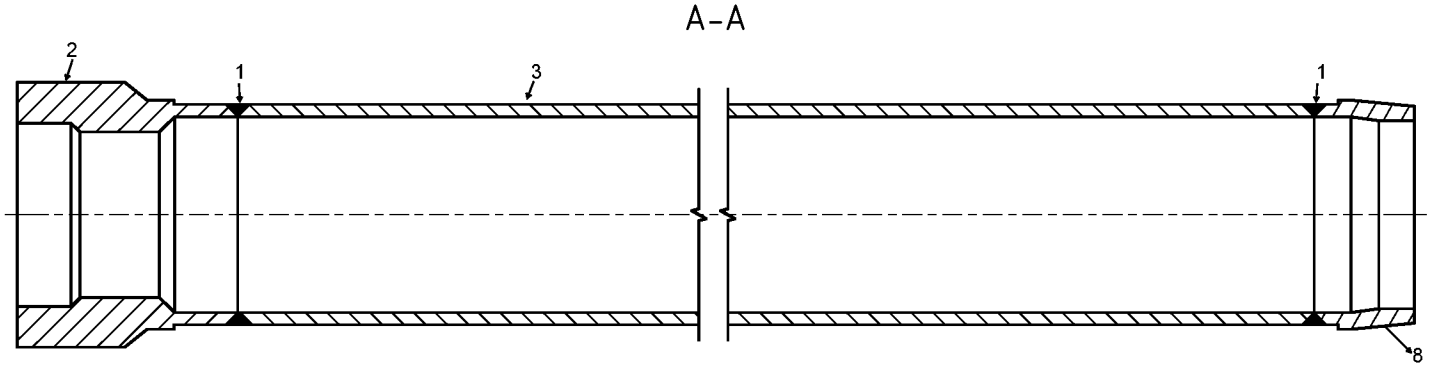
Figure 1b (prior art)
Figure 2A:
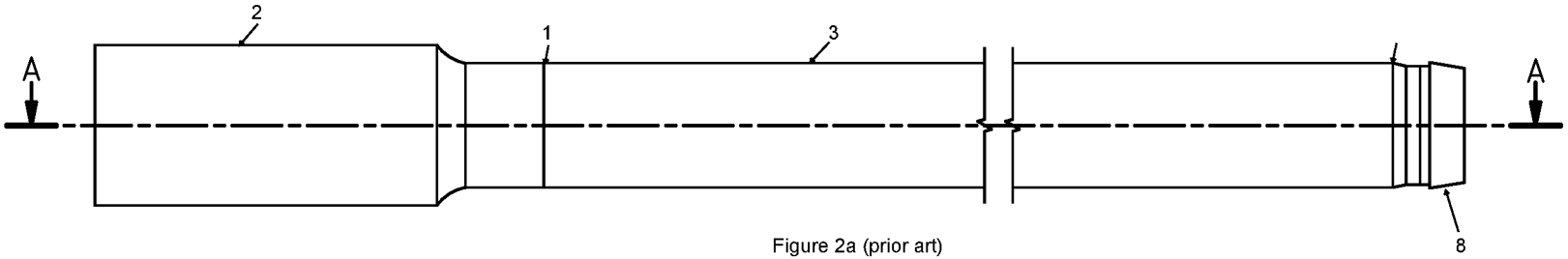
Figure 2a (prior art)
Figure 2B:
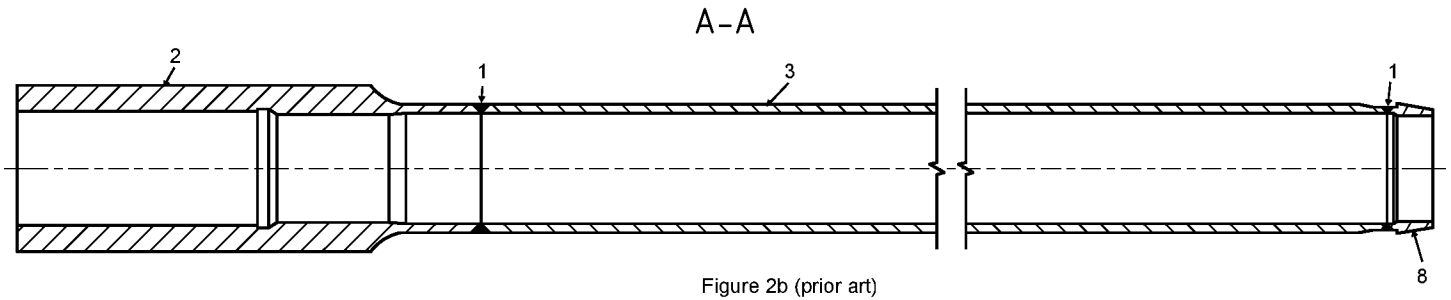
Figure 2b (prior art)

FIG. 2*a* shows a typical prior art upper surface joint,

FIG. 2*b* shows the section A-A in FIG. 1*b,*

Figure 3A:
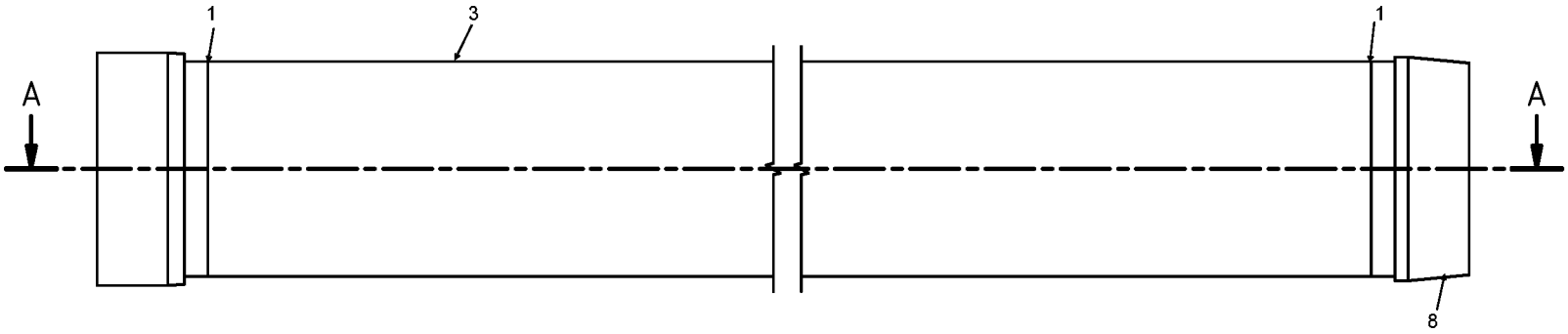
Figure 3a (prior art)
Figure 3B:
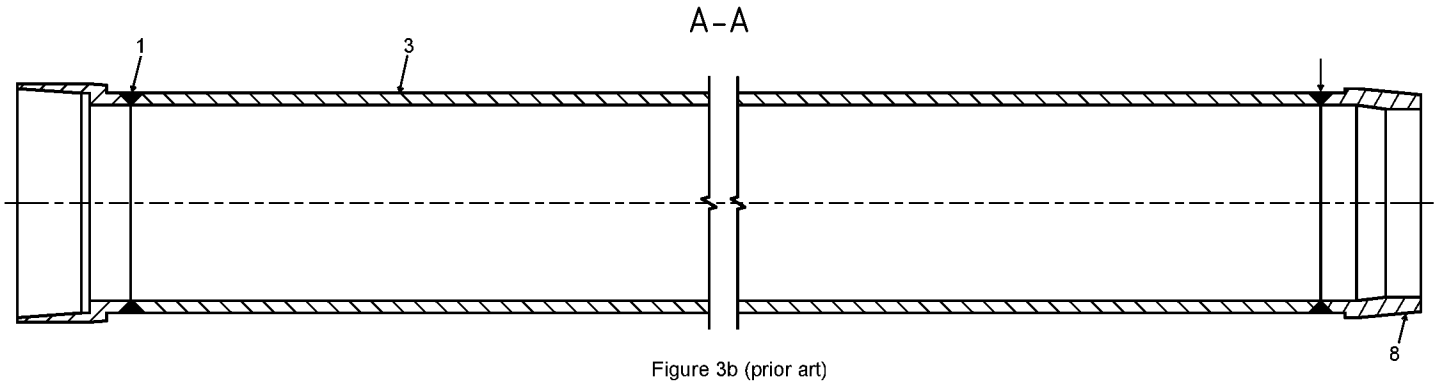
Figure 3b (prior art)

FIG. 3*a* shows a typical prior art lower conductor or surface joint,

FIG. 3*b* shows the section A-A in FIG. 3*a,*

Figure 4A:
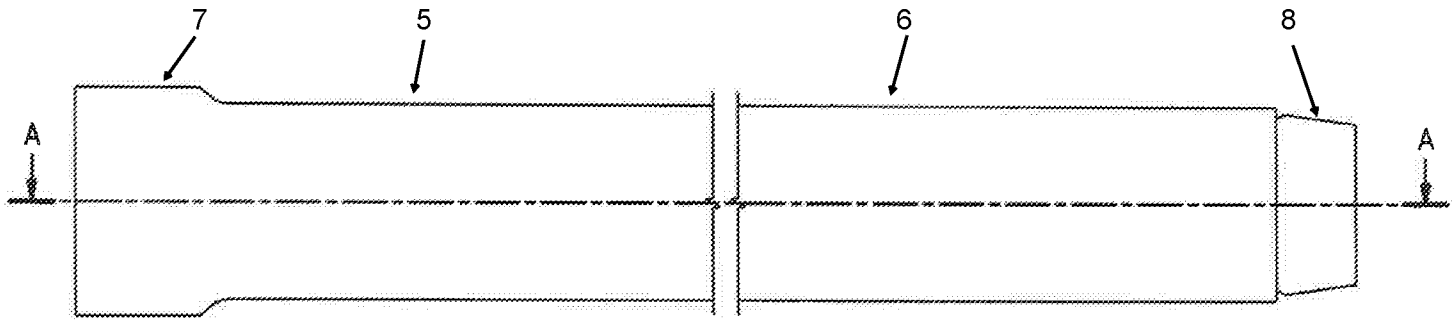
Figure 4B:
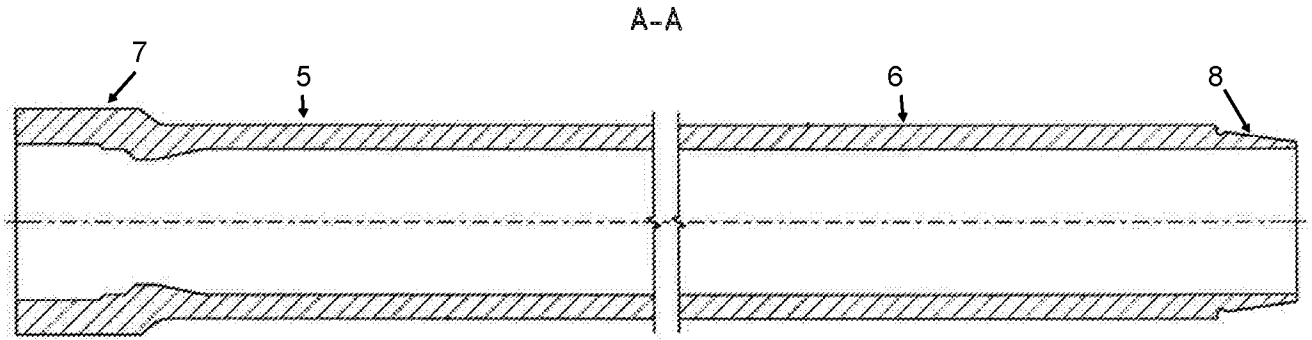

FIG. 4*a* shows an embodiment of an upper conductor joint according to the present invention, FIG. 4*b* shows the section A-A in FIG. 4*a,*

Figure 5A:
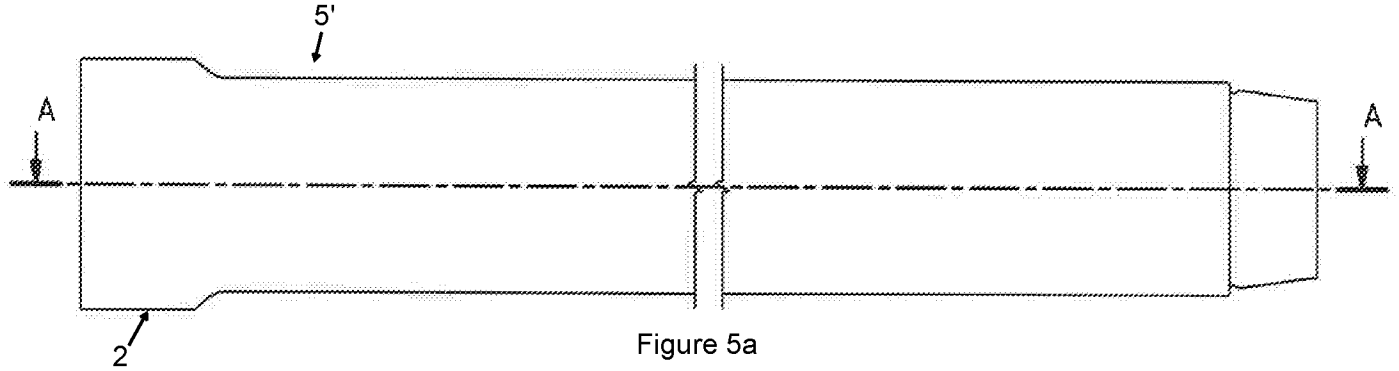
Figure 5B:
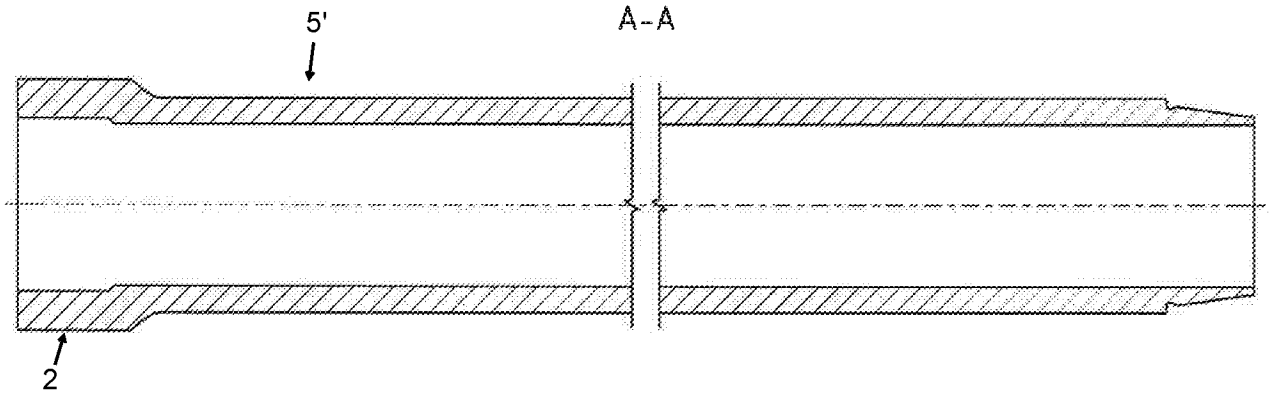

FIG. 5*a* shows an alternative embodiment of an upper conductor joint according to the present invention, FIG. 5*b* shows the section A-A in FIG. 5*a,*

Figure 6A:
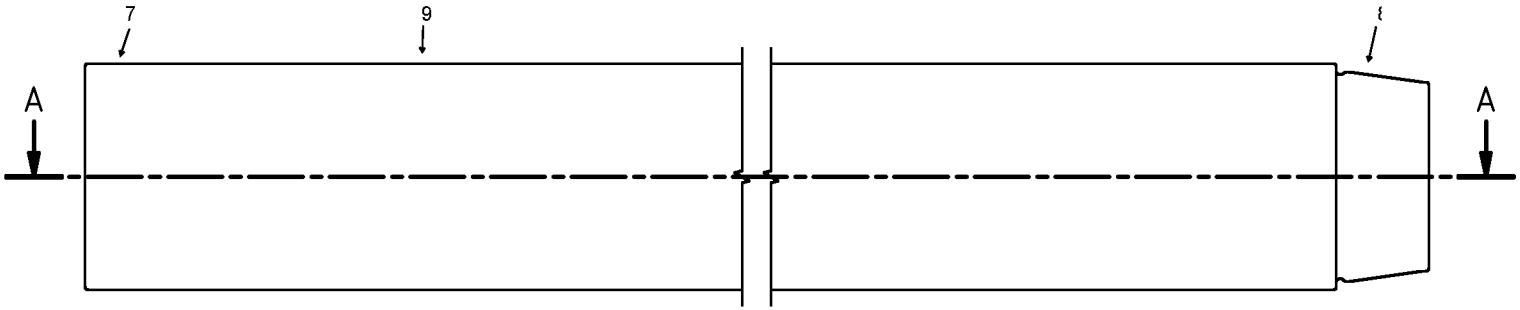
Figure 6B:
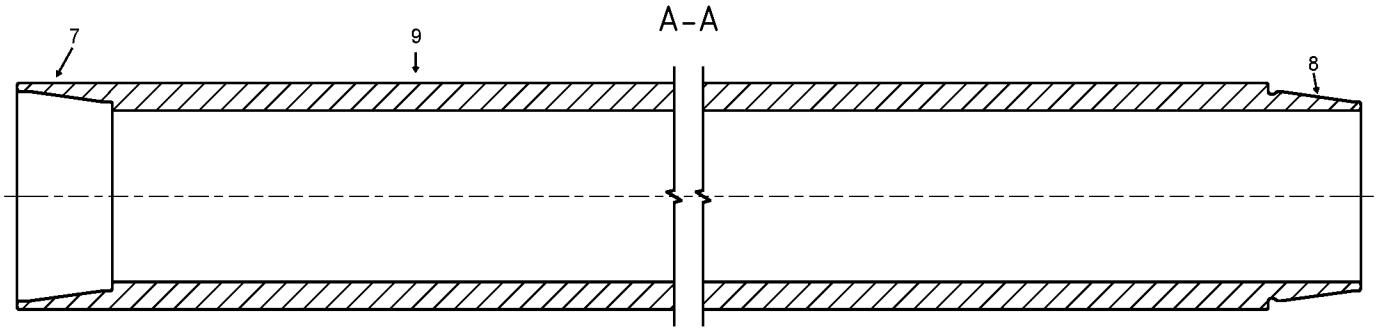

FIG. 6*a* shows an embodiment of a lower conductor joint according to the present invention, FIG. 6*b* shows the section A-A in FIG. 6*a,*

Figure 7A:
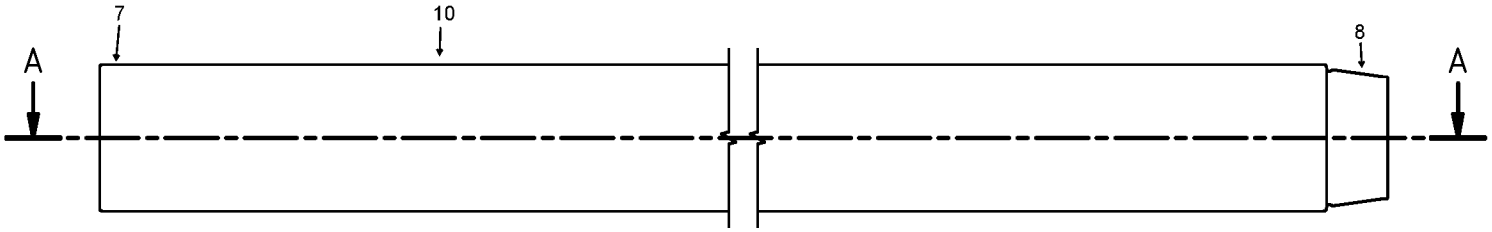
Figure 7B:
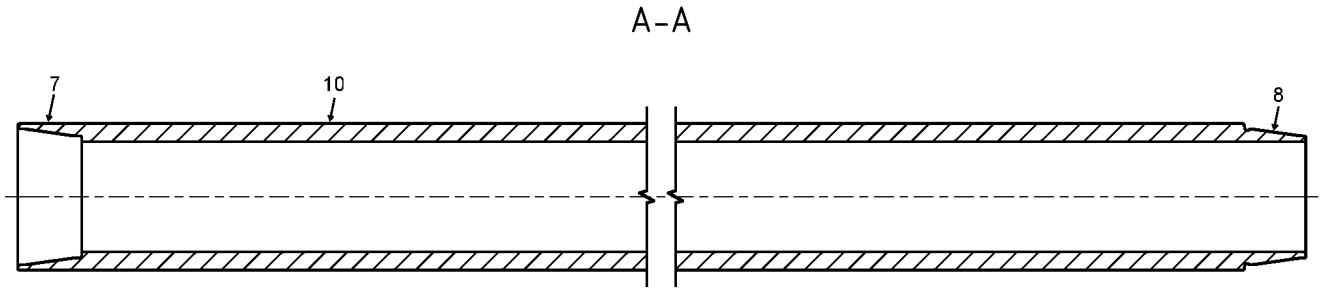

FIG. 7*a* shows an embodiment of a lower surface joint according to the present invention, FIG. 7*b* shows the section A-A in FIG. 7*a,*

Figure 8A:
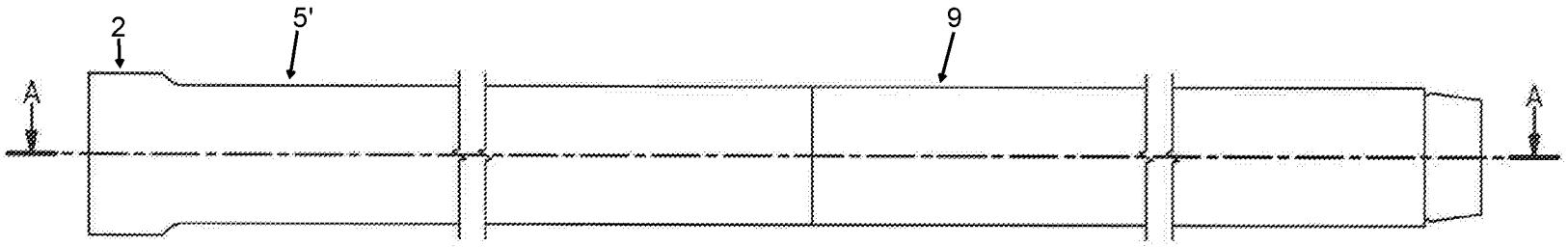
Figure 8B:
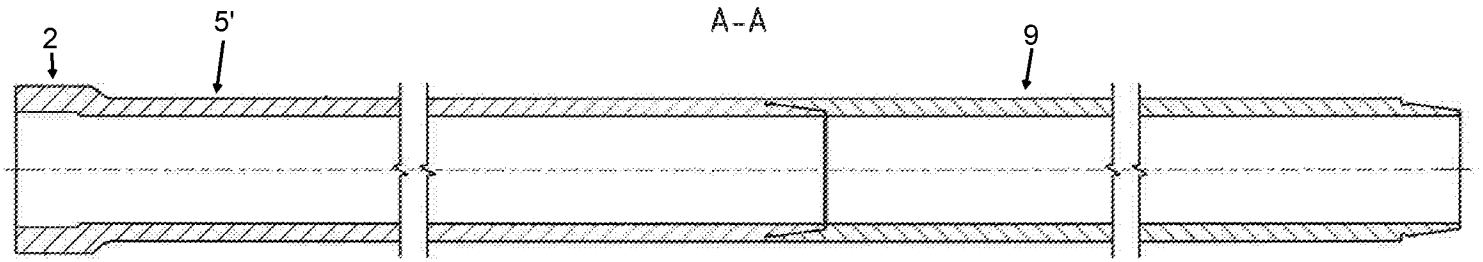

FIG. 8*a* shows a lower conductor joint connected to an upper conductor joint, FIG. 8*b* shows the section A-A in FIG. 8*a,*

Figure 9A:
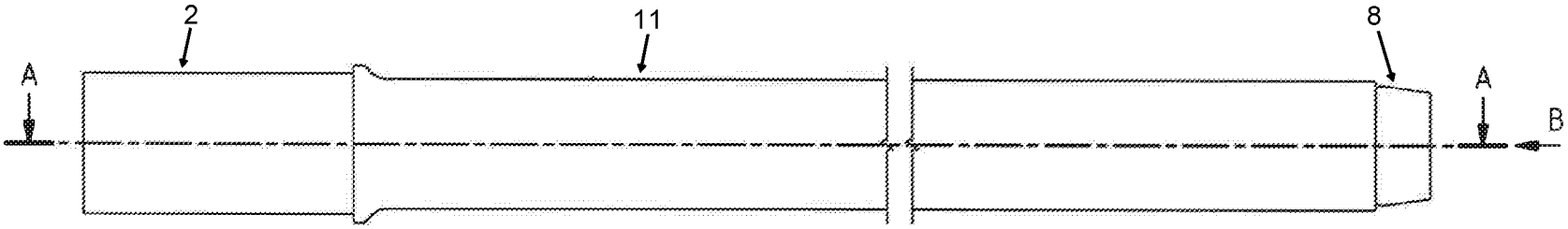
Figure 9B:
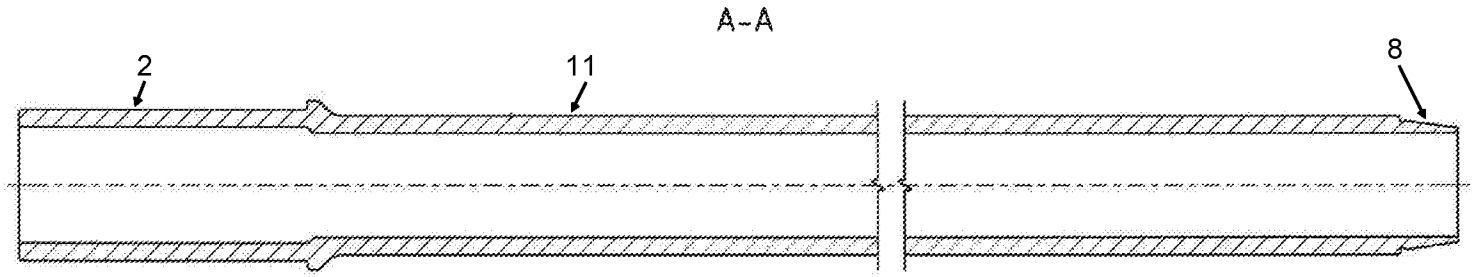

FIG. 9*a* shows an embodiment of an upper surface joint according to the present invention, FIG. 9*b* shows the section A-A in FIG. 9*a,*

Figure 9C:
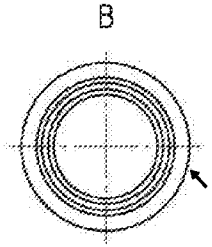

FIG. 9*c* shows the view B in FIG. 9*a,*

Figure 10A:
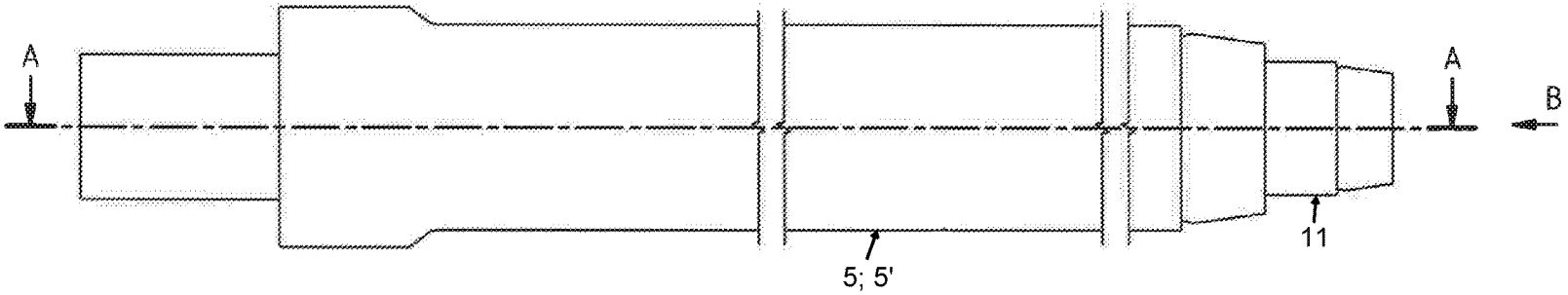
Figure 10B:
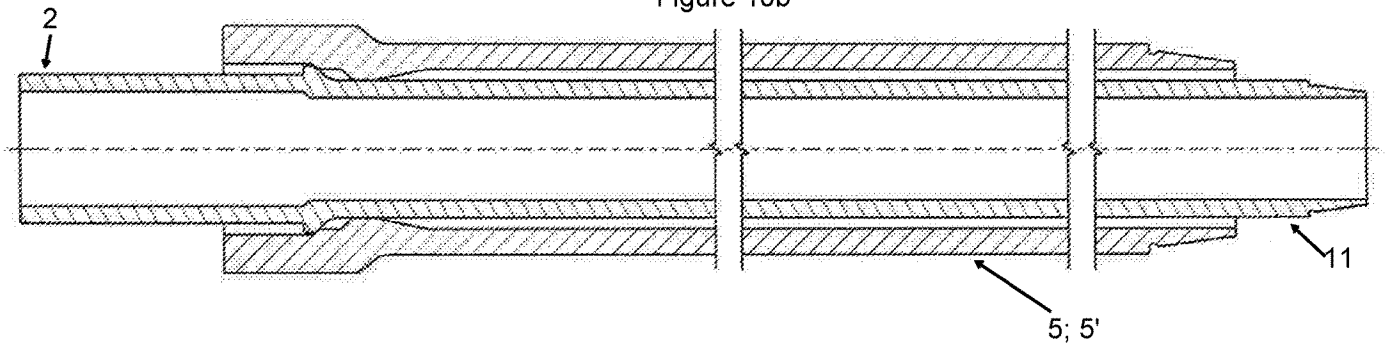

FIG. 10*a* shows an upper surface joint inside an upper conductor joint,

FIG. 10*b* shows the section A-A in FIG. 10*a,*

Figure 10C:
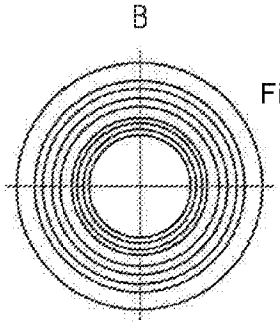

FIG. 10*c* shows the view B in FIG. 10*a,*

Figure 11A:
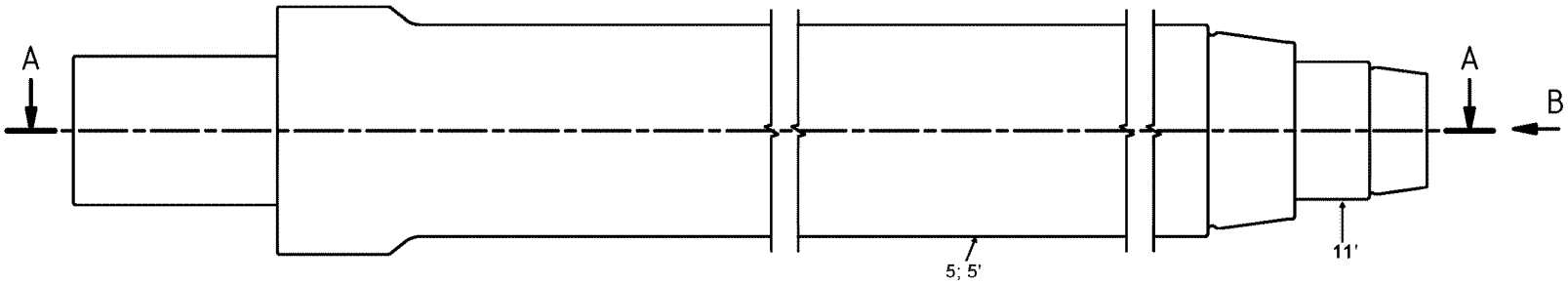
Figure 11B:
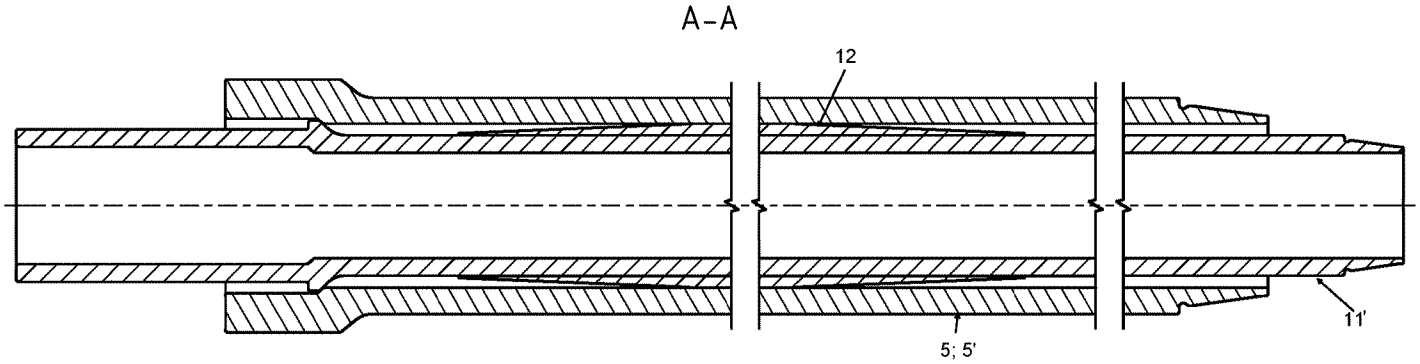

FIG. 11*a* shows an alternative embodiment of an upper surface joint inside an upper conductor joint, where the upper surface joint comprises fins, FIG. 11*b* shows the section A-A in FIG. 11*a,*

Figure 11C:
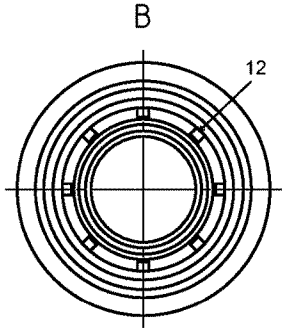

FIG. 11*c* shows the view B in FIG. 11*a,*

Figure 12A:
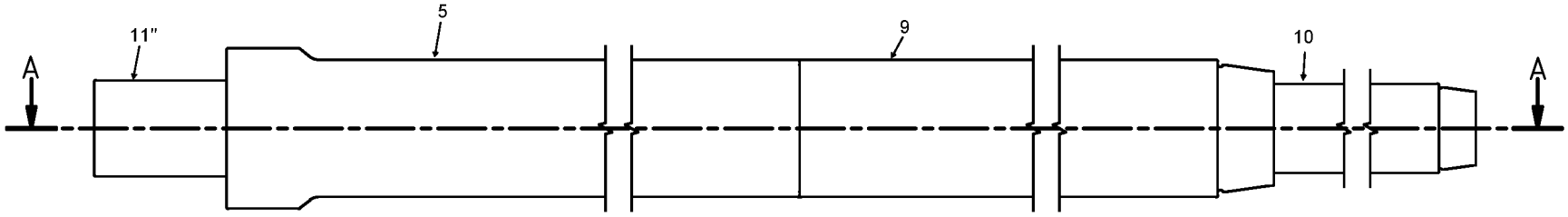

FIG. 12*a* shows an assembly of a lower surface joint connected to an upper surface joint inside an upper conductor joint connected to a lower conductor joint. The lower reaction point between the surface joint and the conductor joint is moved further down and below the area normally called the housing. The reaction is provided by a reaction ring with flow-by sections. The reaction ring cross section is designed with a hemispherical profile.

Figure 12B:
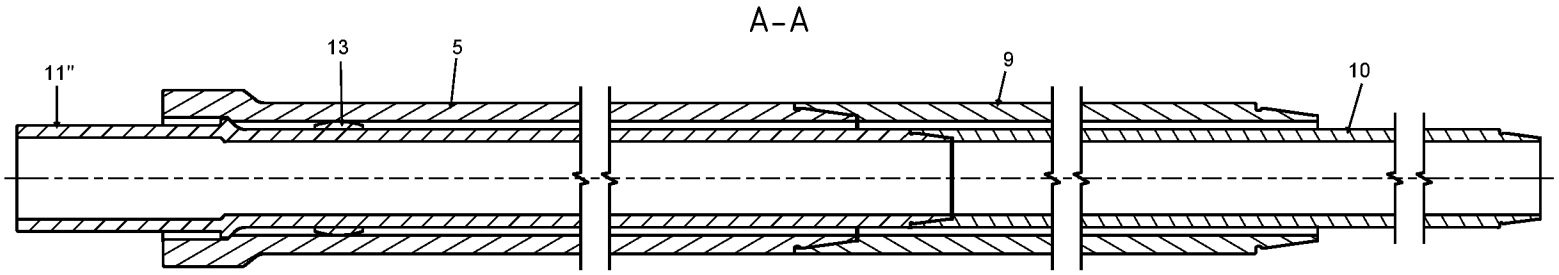

FIG. 12*b* shows the section A-A in FIG. 12*a,*

Figure 12C:
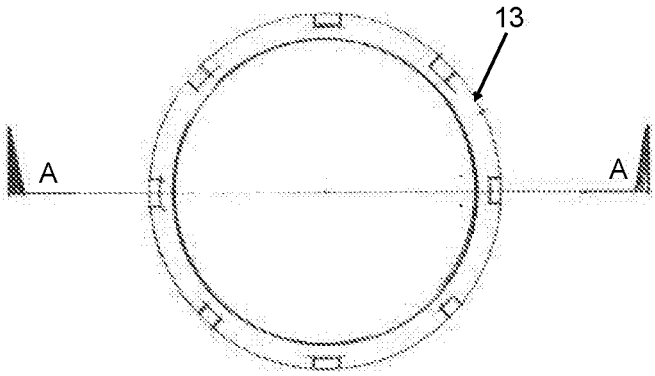
Figure 12D:
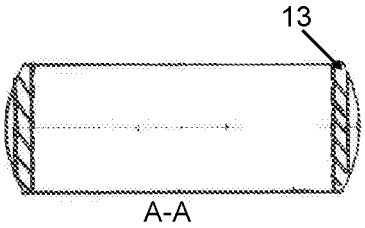

FIG. 12*c* shows the view A-A in FIG. 12*d,*

Figure 13:
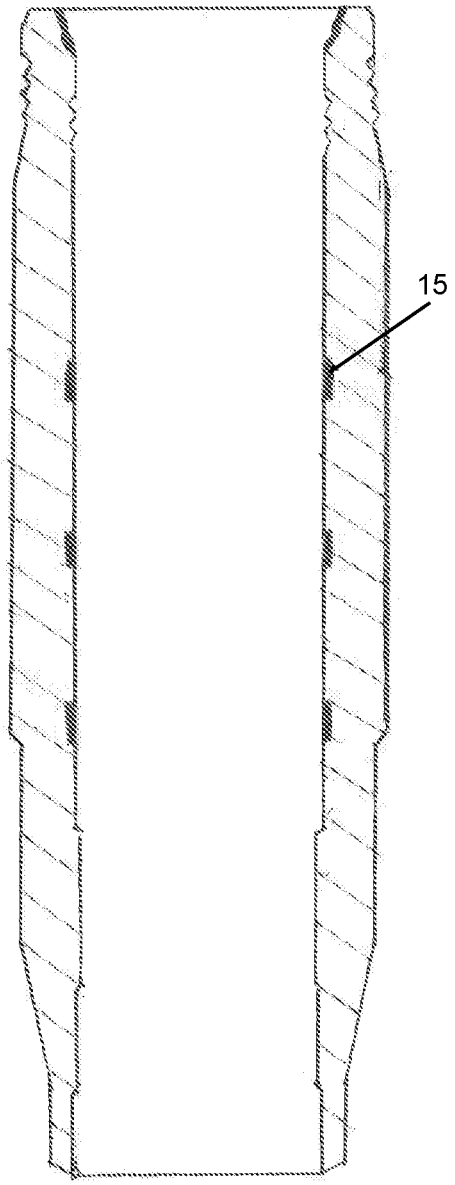
Figure 13 (prior art)
Figure 14:
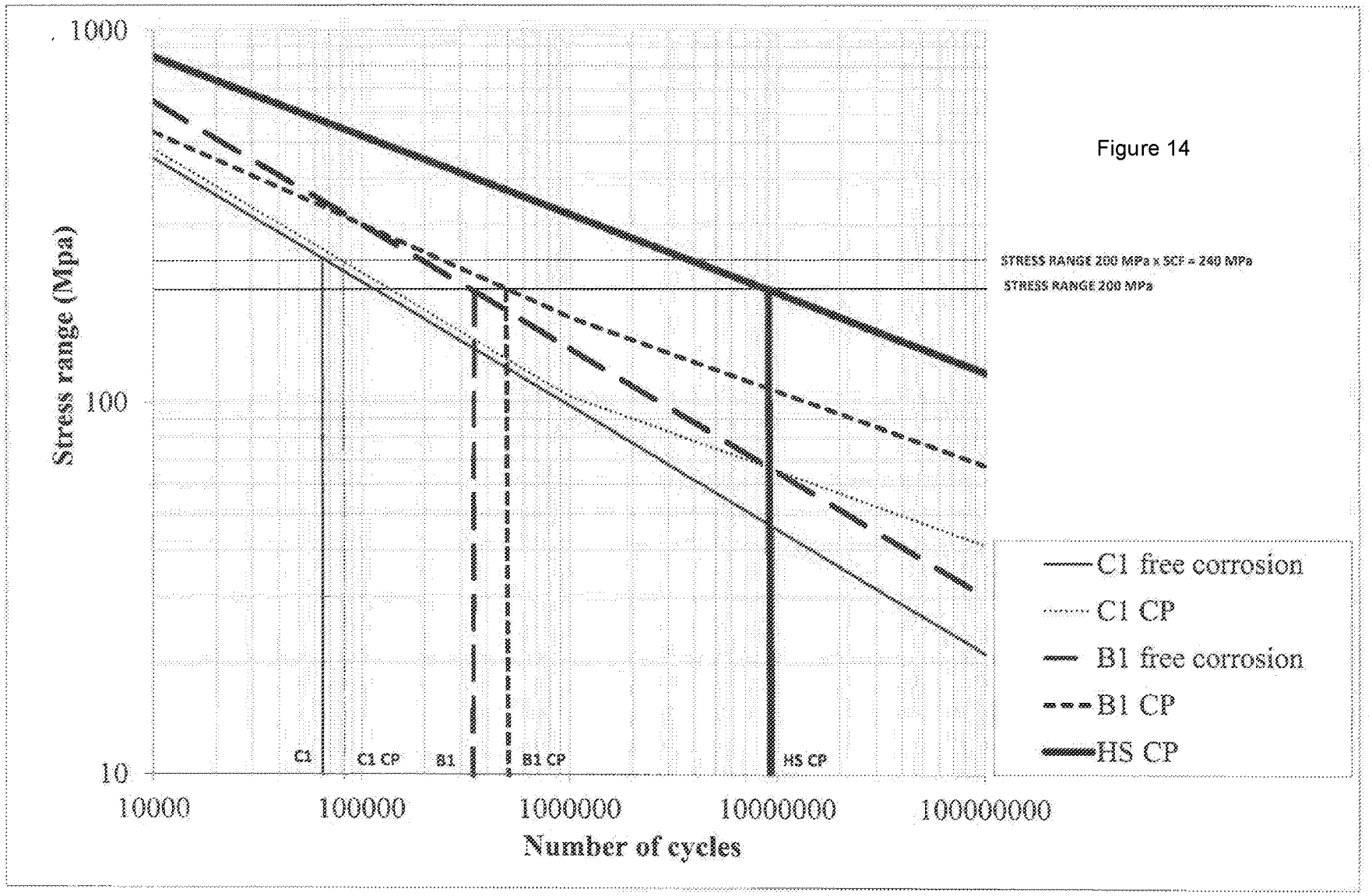

FIG. 12*d* is a partial end view, from the right side of FIG. 12*c*, of the reaction ring, FIG. 13 shows typical sealing areas on a sub-assembly prior to welding of the high pressure housing according to prior art, FIG. 14 shown the SN diagram including the C1 curve, the C! CP curve, the B1 curve, the B1 CP curve and the HS CP curve with comparison of the fatigue life for prior art and the invention.

DETAILED DESCRIPTION

The present invention primarily concerns the upper part of the wellhead that is exposed to bending loads and vibrations. This comprises the parts of the wellhead protruding above the seabed and down to the fix point. The depth of the fix point below the seabed may vary from field to field and is influenced by the soil conditions. It may typically be 10-15 meters below seabed, but can be as deep as down to 50 meters or more.

Prior art wellhead systems design is not optimized with respect to fatigue life due to the the design and fabrication method that is based on welding of parts together and the post weld heat treatment, PWHT, of the welded connections, clad welding of the sealing surfaces and PWHT after clad welding. Due to fabrication by welding parts together and clad welding of the sealing surfaces the fatigue life is calculated, in best case, according to the C1 curve.

In the past the prior art technology was considered good enough and safe. Fatigue life calculations according to the C1 curve was considered good enough for a typical application. The introduction of $5^{th}$ and $6^{th}$ generation drilling vessels, considerably longer well operations, drilling in northern areas in harsh environments, increased loads and the duration of the loads to which the wellheads are exposed, has involved that wellhead system at least in the northern area are delivered with marginal fatigue life. It is uncertain if the remaining fatigue life of several hundred subsea wells in the North Sea is sufficient to carry out maintenance, side step drilling operations or plug and abandonment in a safe manner. In order to increase the margins and to use more realistic drilling loads in the fatigue calculations DNV has recommended in NORSOK U-001 to increase the loads to which the wellheads are exposed. This will contribute to even shorter fatigue life for prior art technology.

Pipes are typically fabricated from plates that are rolled and welded together. Pipe may also be fabricated without welding ref. seamless pipe. For both pipe fabrication methods the pipe is fabricated to tolerances that create uneven fit between the pipe and the accurately machined parts. Out of roundness tolerances, diameter tolerances and wall thickness tolerances contributes to stress concentrations. Welding of parts does also introduce highly stressed areas named hot spots.

As the design and the fabrication method of prior art contributes to limited fatigue life, the design and the fabrication method has to be changed. By changing the design and fabrication method according to the present invention, possibilities opens up for use of raw materials with uniform material properties, increased structural capacity, materials without fabrication tolerances that creates stress concentrations, materials without reduced strength due to post weld heat treatment and materials without hot spots due to welding. These changes represent a step change and allow the fatigue calculations to be performed according to the B1 and HS SN curves.

The change of the design and the fabrication methods can therefore be considered to be an important aspect of one aspect of the invention. The non-welded conductor and surface joints are machined from one single piece of forged raw materials preferably with increased section modulus.

Fabrication of non-welded conductor and surface joints may provide a simplifying contribution due to less process steps, less work locations, less handling and less need for transportation. The invention is suited for less labor intensive automated fabrication. The benefit of introducing new design and fabrication method may thus be faster fabrication with reduced risk of NCR, rework and scrapping, and ultimately lower fabrication costs.

Introduction of one piece extended forgings makes it possible to design each joint with unconventional geometry and dimensions. Forgings can be manufactured to almost any relevant dimension and with larger wall thickness than prior art joints fabricated with pipe.

The combination of larger outer diameter, increased wall thickness and the use of steel with higher material grade involves increased structural capacity and extended fatigue life. The invention can thus be designed with structural strength to withstand specified external extreme loads according to latest requirements. The invention can also be designed to tolerate and compensate for poor cement bonding and soft soil conditions. Unlike prior art joints, the joints according to the present invention can be designed to at least meet future standards proposed in NORSOK U-001.

FIG. 1—show an example of a prior art conductor upper joint. FIG. 2 shows an example of a prior art surface string upper joint. In general, the prior art conductor and surface string system joints typically include three parts that are welded together by girth welds 1. At the top there is a forged housing 2, typically named the conductor housing for the conductor string and wellhead housing for the surface string. In the middle there is a pipe 3. Typically there is a large wall thickness transition from the forged housings to the pipe. At the bottom there is a threaded machined forging typically named the pin connector 8. The pin connector and the pipe are also normally welded together by girth welds. In addition the pipe customarily comprises a longitudinal weld from its production.

FIG. 3 shows a typical prior art lower joint including the pipe 3, the bottom pin connector 4 and the upper box connector 7.

FIGS. 4*a* and 4*b* shows an embodiment of an upper conductor joint 5 according to the present invention, which is machined from one piece of forged raw material, thereby eliminating girth welds 1 between the pipe 3 and the upper and lower ends 2, 8 of the upper conductor joint. The upper conductor joint 5 according to the present invention comprise a forged cylindrical section 6 as a substitute for the pipe 3. In the embodiment shown in FIGS. 4*a* and 4*b*, integral pin connector 8 and the housing 2 are provided as part of the one piece of forged raw material of each section. FIGS. 5*a* and 5*b* shows an alternative embodiment of an upper conductor joint 5' according to the present invention.

FIGS. 6*a* and 6*b* shows an embodiment of a lower conductor joint 9 according to the present invention with integral pin 8 and box 7 connections, which is machined from one piece of forged raw material, thereby eliminating girth welds 1.

FIGS. 7*a* and 7*b* shows an embodiment of a lower surface joint 10 according to the present invention with integral pin 8 and box 7 connections, which is machined from one piece of forged raw material, thereby eliminating girth welds 1.

FIGS. 8*a* and 8*b* shows a lower conductor joint 9 connected to an upper conductor joint 5', both machined from one piece of forged raw material, thereby eliminating girth welds 1.

FIGS. 9*a* and 9*b* shows an embodiment of an upper surface joint 11 according to the present invention with integral housing and pin connector, which is machined from one piece of forged raw material, thereby eliminating girth welds 1.

FIG. 10*a*-10*c* shows an upper surface 11 joint inside an upper conductor 5; 5' joint, both machined from one piece of forged raw material, thereby eliminating girth welds 1.

FIG. 11*a*-11*c* shows an alternative upper surface joint 11' inside an upper conductor joint 5; 5', both machined from one piece of forged raw material, thereby eliminating girth welds 1. The alternative upper surface 11' joint comprises fins 12.

FIG. 12*a*-12*d* shows an assembly of a lower surface joint 10 connected to an upper surface joint 11" inside an upper conductor joint 5' connected to a lower conductor joint 9. The alternative upper surface joint 11" comprises a load reaction ring with machined axial flow-by sections located deeper into the conductor string than typical prior art and below the area named the conductor housing.

FIG. 13 shows typical prior art sealing areas 15 inside the wellhead housing as a sub-assembly prior to welding.

FIG. 14 shows an SN diagram were the fatigue life for prior art and the invention is plotted for similar loads, dimensions and wall thickness. It shows the curves for C1 free corrosion, C1 with corrosion protection (CP), B1 free corrosion, B1 CP and HS CP. The C1 curve applies for welded constructions. The B1 curve applies for base material without welding and the HS curve applies for base material with yield strength equal to or higher than 500 MPa without welding and with a surface finish equal to or better than Ra 3.2, The diagram is logarithmic. The number of cycles increases logarithmically towards the right side of the diagram. The stress range is plotted on the vertical axis. The load for prior art is in this case multiplied by an overall stress concentration factor of 1.2

The present invention provides fewer geometrical transitions as well as smoother geometrical transitions. By increasing the wall thickness of the cylindrical forged sections of both the conductor and surface joints the wall thickness difference between the upper parts housings and the cylindrical sections will be reduced, hence smoother transitions. Examples of this can easily seen by comparing the prior art FIGS. 1-2 with the Figs. of the present invention.

The pin connector 8 at the lower end of the upper joints and the pin and box connectors 7, 8 of the lower joints 9, 10 can be machined within the OD and ID envelope of the cylindrical sections, hence elimination of transitions related to the pin and box connectors 7, 8.

The present invention enables flush ID and OD at the threaded connections 7, 8. This is possible as the box and the pin connectors 7, 8 are machined within the OD and ID of the cylindrical section 6 (ref. FIGS. 6*a*, 6*b*, 7*a*, 7*b*).

The distance between the upper and lower reaction point for prior art technology is relatively short and in the range of 300-400 millimeters. The present invention provides an option for increased distance between upper and lower reaction point. This is possible as the conductor joint is machined from a one piece forging. The load ring can be located deeper into the conductor upper joint and below the area normally called the conductor housing. By increasing the distance between the reaction points the reaction loads are reduced. The capacity of coupled pairs is a function of the distance between the reaction points. For coupled pairs it is therefore possible to decrease the bending stresses with the same ratio as the distance between the reaction points are increased. (Assuming the load path is statically determined).

By reducing the reaction loads the stress-level is reduced. Reduction of the stress level at internal hotspots contributes also to increased fatigue life. The cross section of the load reaction ring may be of hemispherical design.

Other means of extending the distance between the upper and lower reaction points by introduction of vertical fins 12 shown on FIG. 11*b*. The integral vertical reaction fins 12 can be extended axially. The fins 12 alongside the surface string upper joint will increase the stiffness of the surface string upper joint 11'. The integral fins 12 can be designed with for installation guiding and smooth stress transition One possible embodiments of a semi spherical shaped ring is shown on FIGS. 12*c* and *d*.

According to one embodiment of the present invention, the wall thickness of the conductor and surface joints may be increased and made more uniform. By increasing the wall thickness and making it more uniform, the structural strength and fatigue life of the conductor and surface joints may be vastly increased as compared to conventional wellhead systems. However, even if conventional wall thicknesses are maintained, the fatigue life of the conductor and surface joints will be increased according to enclosed SN diagram, ref. FIG. 14.

According to one embodiment of the present invention, the surface joint wall thickness may typically be 1-3" or more.

According to another embodiment of the present invention, the conductor joint wall thickness may typically be 1" to 6" or more.

According to another embodiment of the present invention, the conductor joint OD may typically be 30" to 40" or more.

By providing conductor and surface joints machined from one piece of forged raw material, each joint may be heat treated as one unit and during fabrication at the forging plant. Therefore the material properties, as per the material certificate, will remain unchained throughout the complete life of the project. Heat treatment as one piece and one material contributes to uniform grain structure and improved mechanical properties. Uniform mechanical properties are also achieved by use of steel with good and even hardenability throughout the cross section of the material.

When the girth welds 1 in conductor and surface joints pipe are removed, the risk involved by welding and PWHT (Post Weld Heat Treatment) in prior art conductor and surface joints is removed.

When pipe is no longer part of the fabrication process and final assembly the stress concentration factor related to pipe fabrication tolerances can be disregarded.

When the girth welds 1 in conductor and surface joints pipe are removed, the number of stress hot spots is reduced as the welding hot spots are eliminated.

When welding forged upper and lower ends to the pipe, there will typically be a lower grade material of the pipe. Due to having different materials it is often a challenge to obtain low enough hardness for both the forging and the pipe of the weld without losing strength on the pipe side. To reduce hardness sufficiently on the forged side there is often a risk that the PWHT process can lead to reduced strength on the pipe side. This potential risk will be removed having the whole conductor and surface joints in one forged piece.

As an example only, piping grades of API 5L ×56, ×60 and ×65 are commonly used in the industry due to good weldability. The high strength API 5L piping grade ×80 is also used but less common. It is possible to weld grade ×80 within NACE sour service requirements however it is not granted that all welding shops are capable of welding ×80. Only best suppliers are capable of welding grade ×80. When grade ×80 is welded to either AISI 8630 or ASTM A182 F22 heat treatment is always required. PWHT is required to reduce the hardness of AISI 8630 or ASTM A182 F22 material. Typically reduction of hardness in the forged material is achieved at the cost of reduced strength in the pipe material.

Generally wellhead joints according to the invention can be provided with higher material strength than typical prior art wellhead systems in relation to weldability, hardness and reduction of strength can be disregarded The rationale for improved wellhead fatigue life and structural strength is summarized in the below points a-j:

a) Fabrication of wellhead joints from one single piece of forging without girth welding, clad welding and post weld heat treatment.
b) Use of high strength material with uniform material properties.
c) Corrosion protection of the sealing surfaces by a process without heat effects that compromises the material properties or the basis for fatigue calculations according to B1 and the HS curves.
d) Elimination of welding hot spots.
e) Elimination of pipe tolerance stress concentrations.
f) Reduced number off and degree of geometrical transitions.
g) Increased distance between upper and lower reaction point.
h) General corrosion protection.
i) Surface finish equal to or better than Ra 3.2 and yield equal to or higher that 500 MPa.
j) Increased wall thickness and outer dimensions.

The combination of "a,b,c" preferable in order to calculate the fatigue life according to the SN curve B1 free corrosion. "d" and "e" represents consequences of "a-c". "f"

and "g" represents factors that may eliminate or reduce the stress level at internal or external hot spots and thereby further improves the invention.

When including element "h" it is possible to calculate the fatigue life according to B1 CP curve. By adding "i", the fatigue life calculations can be performed according to the HS CP curve. It is calculations according to the HS CP curve that gives the highest level of fatigue life.

Introduction of "j" is possible as forgings easily can be provided with increased outer diameter and wall thickness. Forgings can be supplied in dimensions that are not easily available from pipe-mills. By exploiting the possibilities provided by introducing "j" almost unlimited fatigue life can be obtained. The potential for severe fatigue damage of the wellhead system due to use of $5^{th}$ and $6^{th}$ generation drilling vessels and considerably longer well operations is thereby eliminated.

The annulus sealing surfaces inside the wellhead housing on prior art may or may not be corrosion protected. The sealing surface for the BOP/XT metal gasket is always corrosion protected on prior art wellheads systems. Earlier the sealing surface was typically corrosion protected by UNS S31600 a nickel-chromium alloy. Typically corrosion resistant alloys with higher nickel-chromium content such as Inconel 625 alloy (UNS N0625) is used on current prior art. Both the low and high nickel-chromium content alloys were and are applied by a welding process with a corresponding post weld heat treatment performed in a furnace enclosing the complete high pressure housing as a sub-assembly.

The corrosion protection alloy, CRA, is typically welded onto a rough machined and NDT verified profile on prior art technology. NDT is performed to ensure no surface defects in the base material prior to welding of the CRA. The wellhead housing is then removed from the welding station and transported to the machine shop. Final machining is performed after welding of the CRA.

Volumetric and surface NDT is typically performed on the CRA as well as thickness verification and surface roughness verification. Typically the welding of the CRA is performed in two passes. The purpose is to limit the iron content of in the Inconel alloy. Positive material identification is typically required after welding to ensure that the iron content is less than 10% at the surface of the CRA. Typically the finished CRA thickness is specified to 2 mm or more in order to ensure less than 10% iron content. Based on approved NDT reports the wellhead housing is heat treated after welding of CRA and before welding to the pipe. If the CRA welding is un-successful, the alloy has to be removed by machining and the process repeated.

The application of corrosion protection of the sealing surfaces of prior art wellhead housing includes several processes steps at different work locations. Application of the CRA is time consuming and involves risk of defects and rework. The number of process steps for fabrication of the invention is less than for prior art. Handling, transport and the logistics are simplified. The risk of welding related problems such as, surface defects, lack of fusion or too high iron contents is by the invention are reduced or eliminated.

If the CRA on the sealing areas is applied on a wellhead joint made from one piece of forging without girth welding and PWHT the fatigue life still has to be calculated according the C1 curve or less. As long as the CRA on sealing surface is applied by clad welding and PWHT the B1 curve cannot be applied even if the joint is made from one piece forging.

Hence the clad welding and corresponding PWHT must be substituted by a process that ensures corrosion protection of the sealing surfaces without heat effects that affects the material properties or the basis for fatigue calculations according to B1 and the HS curves.

An example of other process that does not compromise the material properties or the basis for fatigue calculations according to B1 and the HS curves is an electrolytic process. Brush electroplating is a process that has several advantages over tank plating including portability to site and possibility to plate selected portions of the surface upper joint. The sealing surfaces may be corrosion protected by one or more layers of corrosion resistant alloys or non-alloys or combination of layers of alloys and non-alloys.

The sealing surfaces of the invention may be corrosion protected with a hard faced nickel-chromium alloy. Other alloys with good corrosion resistance may also be applied. Non-alloys with good corrosion resistance may also be applied. A possible solution is the combination of several layers of alloy, non-alloys or alloy and non-alloy.

It is possible to apply the corrosion protection on a finished machined sealing surface with specified surface finish and slightly increased dimensions. The assembly will be completed according to specified dimensions and tolerances when the corrosion resistant coating is applied.

Hence fabrication can be completed at one work station only compared with minimum 3 off machining operations for prior art.

The electrolytic process can be completed within some hours. As welding is not required the risk of high iron content in the CRA is eliminated. Therefore the CRA can be much thinner and in the range of μ rather than millimeters. By machining the seal areas to a predetermined oversize the correct final dimension of the sealing surfaces can accurately be achieved when applying the corrosion resistant alloy or non-alloy onto the sealing surfaces. The risk of welding defects is eliminated. Item "c" is fulfilled by applying the corrosion resistant alloy or non-alloy by a process without heat effects that affects the material properties or the basis for fatigue calculations according to B1 and the HS curves.

Further enhancement of the fatigue life may be achieved by providing general corrosion resistance. Each joint of the conductor string and the surface string can be corrosion protected by an electrolytic corrosion resistant alloy or non-alloy or by other type of coatings applied by other methods. Typically tank plating may be assumed for the general corrosion protection. This is a common industrial process that requires minimal attention and that provides simultaneous corrosion protection on the inside and the outside of the wellhead joints. Other forms of general corrosion protection may be contemplated.

Other methods may be e.g. thermal sprayed aluminum, assuming it does not change material properties, or epoxy paint with zinc powder. As for the sealing surfaces the general corrosion protection coating shall be applied without heat effects that compromise the material properties or the basis for fatigue calculations according to B1 and the HS curves. Corrosion protection does not eliminate corrosion of the base material completely, but the anode material of the different corrosion protection coatings reduces the corrosion rate of the base material to a very low level.

The reduction of the wall thickness of the base material is by applying corrosion protection ignorable during the lifecycle of the product.

The combination of "a-g" and "h" ensures fatigue calculations according to the B1 CP curve. The effect considering same load, outer diameter and wall thickness is a minimum improvement of 5 times increased fatigue life. By taking into account the possibilities of increased wall thickness and outer diameter as offered according to "j" by use of forgings the fatigue life can be improved by a factor of typical 50 times. The reason for this is that for the same load giving a stress range of 300 MPa it would be possible to enter the stress range at 150 MPa due to increased section modulus. By introducing "i" the fatigue life can be calculated according to a HS CP curve. The effect considering same load, outer diameter and wall thickness is a minimum improvement of 74 times increased fatigue life. By taking into account the possibilities of increased wall thickness and outer diameter as offered by use of forgings the fatigue life can be improved by a factor of approximately 3000 times. By such improvement fatigue damage as a risk element is eliminated. The benefit can be utilized by increasing the stress range. That implies possibilities for drilling and completion in rougher weather conditions thereby reducing the number of days with waiting on weather.

It should be pointed out that some increase the fatigue life can be obtained by applying general corrosion resistant coating onto prior art conductor string and the surface string joints. The fatigue life of prior art can then be calculated according to the C1 CP curve that increases the fatigue life marginally in the region above 100 MPa stress range. The invention may therefore also include general corrosion protection of prior art technology.

The non-welded design and fabrication method can be applied to any suppliers portfolio. The interfaces will not be influenced hence existing running tools, casing hangers and annulus seals can be used as is. The external locking profile for the BOP and XT connector may also remain unchained. The invention is also compatible with increased loads transferred to the surface string upper joint by high capacity BOP and XT connectors. High capacity connectors can transfer higher loads and expose the wellhead for higher bending moments from the riser via the external locking profiles than typical connectors used today are capable of.

The present invention makes it possible to progress to a one-design-will-fit-all application. It will be possible to machine wellhead joints to stock for immediate delivery. The benefits of short lead time are obvious and include a competitive advantage (potential for increased market share), advantages for customers (simplifies customers planning), increased customer flexibility and better utilization of drilling rigs, and ultimately lower operational costs for the operator.

The invention claimed is:

1. A subsea wellhead, comprising:

an upper joint, comprising:

a housing at an upper end of the upper joint;

a connection organ at a lower end of the upper joint; and internal and external surfaces;

wherein the housing comprises sealing surfaces;

wherein the upper joint is machined from a single piece of non-welded forged steel material with a uniform grain structure; and wherein the sealing surfaces are corrosion protected by corrosion resistant material deposited without introducing heat effects to the single piece of forged steel material.

2. The subsea wellhead according to claim 1, wherein the corrosion resistant material comprises one or more layers of a corrosion resistant alloy.

3. The subsea wellhead according to claim 1, wherein the corrosion resistant material comprises one or more layers of a corrosion resistant non-alloy.

4. The subsea wellhead according to claim 1, wherein the corrosion resistant material comprises one or more layers of a corrosion resistant alloy and non-alloy.

5. The subsea wellhead according to claim 1, wherein the single piece of forged steel material has a yield strength less than 500 MPa.

6. The subsea wellhead according to claim 1, wherein the single piece of forged steel material has a yield strength equal to or higher than 500 MPa, and wherein a surface finish of internal and external non-sealing surfaces of the upper joint is equal or greater than Ra 3.2.

7. A subsea wellhead, comprising:

a lower joint, comprising:

a first connection organ at an upper end of the lower joint;

a second connection organ at a lower end of the lower joint; and internal and external surfaces;

wherein the lower joint is machined from a single piece of non-welded forged steel material with a uniform grain structure; and wherein the internal and external surfaces of the lower joint are corrosion protected by corrosion resistant material deposited without introducing heat effects to the single piece of forged steel material.

8. The subsea wellhead according to claim 7, wherein the corrosion resistant material comprises one or more layers of a corrosion resistant alloy.

9. The subsea wellhead according to claim 7, wherein the corrosion resistant material comprises one or more layers of a corrosion resistant non-alloy.

10. The subsea wellhead according to claim 7, wherein the corrosion resistant material comprises one or more layers of a corrosion resistant alloy and non-alloy.

11. The subsea wellhead according to claim 7, wherein the single piece of forged steel material has a yield strength less than 500 MPa.

12. The subsea wellhead according to claim 7, wherein the single piece of forged steel material has a yield strength equal to or higher than 500 MPa, and wherein a surface finish of internal and external non-sealing surfaces of the lower joint is equal or greater than Ra 3.2.

13. The subsea wellhead according to claim 1, wherein the upper joint is the upper joint of a surface string of the subsea wellhead.

14. The subsea wellhead according to claim 1, wherein the upper joint is the upper joint of a conductor string of the subsea wellhead.

15. The subsea wellhead according to claim 7, wherein the lower joint is the lower joint of a surface string of the subsea wellhead.

16. The subsea wellhead according to claim 7, wherein the lower joint is the lower joint of a conductor string of the subsea wellhead.

17. The subsea wellhead according to claim 1, wherein a surface finish of internal and external non-sealing surfaces of the upper joint is equal or greater than Ra 3.2 and less than or equal to 6.4.

18. The subsea wellhead according to claim 7, wherein a surface finish of internal and external non-sealing surfaces of the upper joint is equal or greater than Ra 3.2 and less than or equal to 6.4.

* * * * *